US006929053B1

(12) United States Patent
Doty

(10) Patent No.: US 6,929,053 B1
(45) Date of Patent: Aug. 16, 2005

(54) MOLD FILL METHOD AND SYSTEM

(75) Inventor: Herbert W. Doty, Amherst, NH (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/854,290

(22) Filed: May 26, 2004

(51) Int. Cl.[7] ..... B22D 35/04
(52) U.S. Cl. ..... 164/136; 164/336
(58) Field of Search ..... 164/133, 135, 164/136, 336, 337

(56) References Cited

U.S. PATENT DOCUMENTS

| | | | | |
|---|---|---|---|---|
| 3,837,614 | A | 9/1974 | Palovits et al. | |
| 3,863,704 | A * | 2/1975 | Kahn | 164/130 |
| 4,324,392 | A * | 4/1982 | White et al. | 266/240 |
| 4,605,056 | A | 8/1986 | Ohno | |
| 4,993,473 | A | 2/1991 | Newcomb | |
| 5,398,750 | A | 3/1995 | Crepeau et al. | |
| 5,584,334 | A | 12/1996 | Oswald et al. | |
| 5,620,044 | A | 4/1997 | Grenkowitz et al. | |
| 5,704,413 | A | 1/1998 | Takasaki et al. | |
| 5,792,378 | A * | 8/1998 | Christensen et al. | 222/590 |
| 5,906,235 | A | 5/1999 | Thomas et al. | |
| 6,453,978 | B1 * | 9/2002 | Grolla | 164/119 |
| 6,540,007 | B2 | 4/2003 | Meyer | |
| 2002/0084052 | A1 | 7/2002 | Crafton et al. | |

* cited by examiner

*Primary Examiner*—Jonathan Johnson
*Assistant Examiner*—Len Tran
(74) *Attorney, Agent, or Firm*—Charles H. Ellerbrock

(57) ABSTRACT

A mold fill system for metal casting a mold, and associated method. The mold fill system comprises a horizontal primary runner defining a horizontal axis of rotation, a rotation mechanism for rotating the mold about the horizontal axis at an angular velocity, and a gating subsystem configured to receive metal flow from the primary runner and fill the mold uphill during rotation of the mold about the horizontal axis of rotation.

20 Claims, 4 Drawing Sheets

MOLD FILL METHOD AND SYSTEM

FIELD OF THE INVENTION

This invention relates to a method for filling a mold with molten metal for casting, and in particular to method of filling the mold while rotating the mold.

BACKGROUND OF THE INVENTION

Gravitational pouring of molten metal, aluminum in particular, into molds during sand casting can promote oxidation, introduce impurities, and create turbulence causing gas bubbles and oxide inclusions that are detrimental to the aluminum casting.

To avoid the problems associated with traditional gravitational pouring, capital-intensive metal pouring systems, such as high pressure die castings, and bottom filling processes using pressure are used. Bottom filling processes rely on rotation of the mold after fill or on very large top risers that provide feed metal after shrinkage. Both of these approaches can introduce defects.

Therefore, there is still a need to develop mold fill processes that reduce capital investment in new equipment, lower maintenance costs and reduce defects associated with gravitational pouring.

SUMMARY OF THE INVENTION

The present teachings provide a method for filling a mold with molten metal during casting. The method comprises providing a horizontal primary runner of the mold defining a horizontal axis of rotation, providing a plurality of secondary runners communicating with the primary runner, filling the primary runner, rotating the mold about the horizontal axis of rotation at an angular velocity, and filling the mold uphill from the secondary runners.

The present teachings also provide a mold fill system for filling a mold. The mold fill system comprises a horizontal primary runner defining a horizontal axis of rotation, a rotation mechanism for rotating the mold about the horizontal axis at an angular velocity, and a gating subsystem configured to receive metal flow from the primary runner and fill the mold uphill during rotation of the mold about the horizontal axis of rotation.

Other systems, methods, features and advantages of the invention will be or will become apparent to one with skill in the art upon examination of the following figures and detailed description. It is intended that all such additional systems, methods, features and advantages included within this description, be within the scope of the invention, and be protected by the accompanying claims.

BRIEF DESCRIPTION OF THE DRAWINGS

The present invention will become more fully understood from the detailed description and the accompanying drawings. The components in the figures are not necessarily to scale, emphasis instead being placed upon illustrating the principles of the invention. Moreover, in the figures, like reference numerals designate corresponding parts throughout the different views.

DETAILED DESCRIPTION

The following description is merely exemplary in nature and is in no way intended to limit the invention, its application, or uses.

Figure 1:
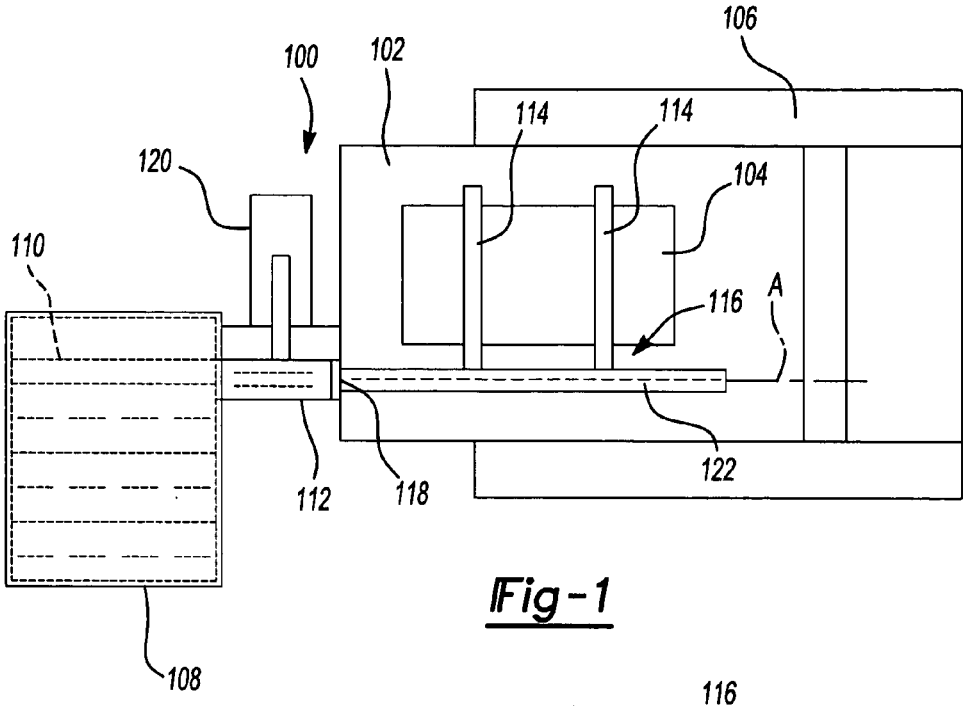
FIG. 1 is a side view of a mold fill apparatus according to the present teachings.

Referring to FIG. 1, an exemplary mold fill system 100 for sand casting metallic parts such as, for example, cylinder heads and engine blocks, according to the present teachings, is illustrated. The mold fill system includes a sand mold 102 having a mold cavity 104 for casting, a gating system 116, and a rotation mechanism 106. The sand mold 102 is supported on the rotation mechanism 106 during casting and is removed from the rotation mechanism 106 after the completion of the casting process by a conveyor or by other known methods of removal and transport.

The sand mold 102 can include sand cores (not shown) as necessary to define interior features of the casting, such as, for example cylinder bores. The sand mold 102 can be a green sand mold or a chemically bonded (precision) sand mold or a combination thereof. The sand cores, for example, can be made of sand bonded with a suitable binder, including phenolic resin, phenolic urethane, or other binder material, while the remainder of the sand mold can be made of green sand. The sand mold 102 can also be a metal mold (permanent mold casting) or metal and sand mold (semi-permanent mold casting).

Figure 2:
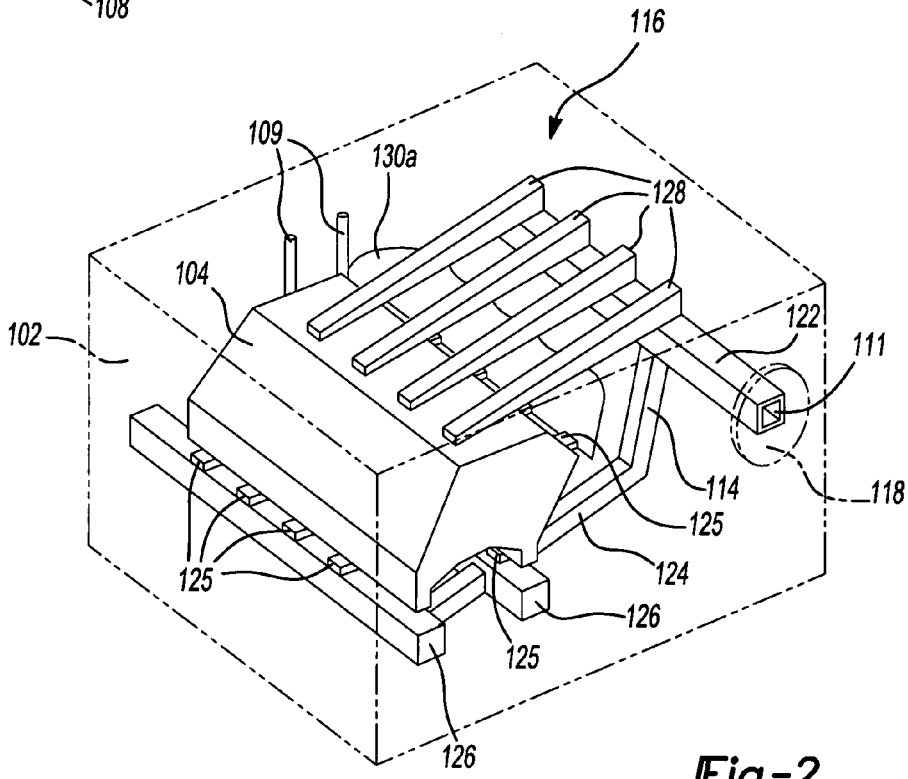
FIG. 2 is a top perspective view illustrating an exemplary gating system for a mold fill apparatus according to the present teachings.
Figure 7:
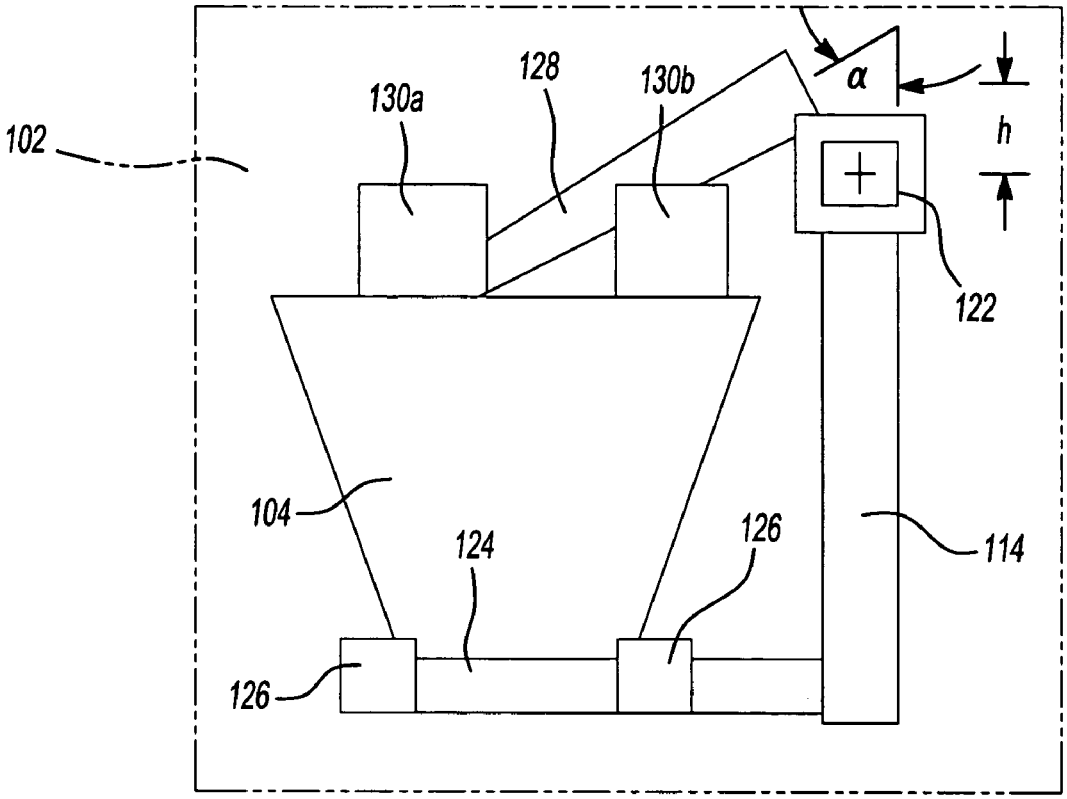
FIG. 7 is side view of the mold fill apparatus of FIG. 3 at the end of the casting operation.

Referring to FIGS. 1, 2 and 7, the gating system 116 includes a primary runner 122 that defines a horizontal axis of rotation "A" about which the mold 102 and the gating system 116 can be rotated by the rotation mechanism 106. The gating system 116 also includes a subsystem of secondary runners, including first secondary runners 114, second secondary runners 124, and third secondary runners 126. The first secondary runners 114 are substantially perpendicular to and communicate with the primary runner 122 for receiving molten metal thereof. The second and third secondary runners 124, 126 define an orthogonal frame communicating with the first secondary runners 114, which are disposed substantially orthogonally to the second secondary runners 124. A plurality of in-gates 125 are positioned to allow ingress of molten flow into the mold cavity 104. Additionally, one or more live vents 109 communicate with the mold cavity 104 to allow gases generated in reactions between the molten metal and the mold 102 to escape to the atmosphere, rather than be trapped in the mold cavity 104 causing casting defects.

Referring to FIG. 7, one or more tertiary runners 128 are inclined at an angle "$\alpha$" from to the primary runner 122 to first and second top risers 130*a*, 130*b*. The tertiary runners 128 extend from a position at height "h" above the primary runner 122. The top risers 130*a*, 130*b* provide feed metal to the casting to eliminate shrinkage defects caused by volumetric contraction of the metal as it solidifies upon cooling. The top risers 130*a*, 130*b* and the third secondary runners 126 remain substantially horizontal and parallel to the primary runner 122 during rotation of the mold 102. It should be appreciated that the shape and dimensions, number, and particular positioning and arrangement of the risers 130*a*, 130*b*, the primary runner 122, the secondary runners 114, 124, 126, the in-gates 125, the vents 109, etc. are merely exemplary, and other shapes and configurations are contemplated herein. The risers 130*a*, 130*b*, for example, can be spherical, rectangular, square, or circular in cross-section, among other shapes. Similarly, the primary runner 122 and secondary runners 114, 124, 126 can have any desirable cross-section. The positioning of the various components of the gating system 116, as well as the actual number of runners can be selected, as appropriate, for a particular part, to conserve mold space, or to improve heat transfer efficiency, etc. The primary runner 122, for example, could be positioned between the risers 130*a*, 130*b* to make the mold smaller.

The primary runner 122 can be brought in communication and coupled to a molten metal source 108 through an opening 111. The metal source 108 provides a continuous supply of molten metal and maintains a constant metal level or height defined by a horizontal free metal surface 110. The molten metal can be aluminum or an aluminum alloy, although other metals, including iron and iron alloys, can also be used for casting according to the present teachings. The molten metal flows from the metal source 108 to the primary runner 122 through a launder or spout 112 at substantially the same horizontal level defined by the metal surface 110. The metal flow can be controlled by a stopper valve 120. A rotating seal 118 is provided between the launder 112 and the primary runner 122 at the opening 111. By maintaining the metal surface 110 at a constant level that is substantially flush with the horizontal primary runner 122, vertical drops in metal flow and associated problems, such as oxidation and turbulence, are reduced or eliminated before entering the gating system 116.

The metal source 108 can be a known holding type furnace, such as, for example, a rotary barrel/drum type furnace or a fixed furnace. In a fixed furnace, the stopper valve 120 can be a stopper rod valve or a slide-gate valve. In a rotary furnace, the furnace can be rotated such that the launder 112 is below the metal to allow metal to flow into the primary runner 122 without vertical drop.

The progression of the casting process during rotation of the mold 102 about the axis A of the primary runner 122 is illustrated in a sequence of end views in FIGS. 3–7. The horizontal molten metal level is indicated by an axis "X". At the beginning of the casting process in FIG. 3, the mold cavity 104 is empty and located above the metal level X, on one side of the axis A. Although in the exemplary illustration of FIG. 3, the mold 102 is positioned to the left of the axis A and the rotation of the mold 102 proceeds counterclockwise, the invention is not so limited. Depending on the particular rotation mechanism 106 and the configuration of other casting equipment, including the furnace and the transporting equipment, relative to the rotation mechanism 106, the mold 102 could also be positioned to the right of axis A for clockwise rotation in a mirror-image configuration. Additionally, the empty mold 102 can be positioned on the rotation mechanism 106 in a different orientation than that shown in FIG. 3, and then rotated to the position of FIG. 3 by the rotation mechanism 106 prior to the start of casting. The rotation mechanism 106 can be any known mechanism capable of supporting and rotating the mold 102 about the axis A, such as, for example, a conventional mold roll-over mechanism, which could already be available in a typical casting workplace.

Figure 3:
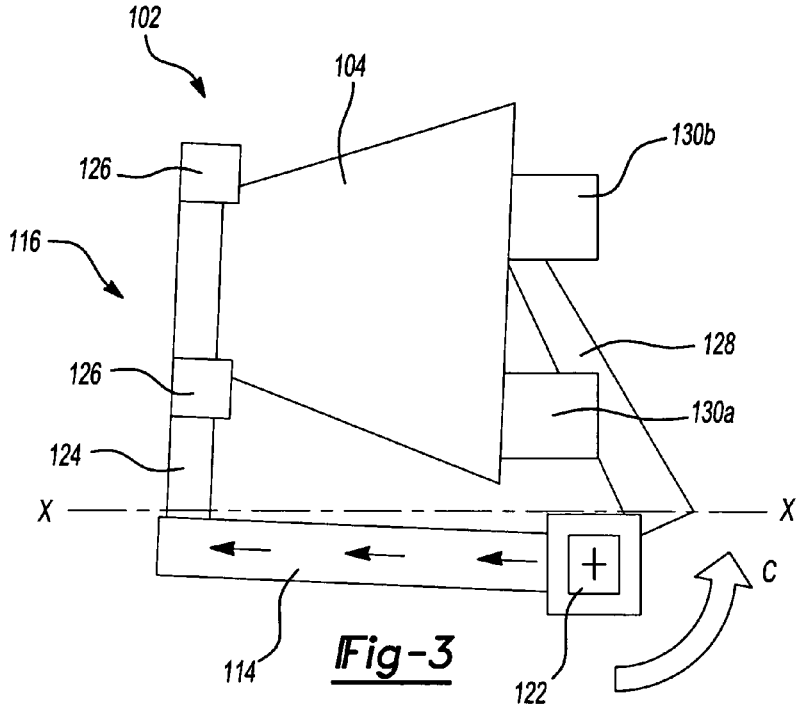
FIG. 3 is a side view of a portion of mold fill apparatus according to the present teachings at the beginning of the casting operation.

Starting from the position of FIG. 3, the stopper valve 120 is opened, or, in the case of rotary furnace, the furnace is rotated as described above, and molten metal flows from the launder 112 into the primary runner 122. After the primary runner 122 is filled, the mold 102 is rotated about the horizontal axis A by an angle of rotation β at a controllable angular velocity causing metal to flow gradually into the gating system 116 and into the first, second and third secondary runners 114, 124, 126. Eventually, as the angle of rotation β increases, metal begins to flow from the third secondary runners 126 into the mold cavity 104, as illustrated in FIGS. 4–7. The rotation mechanism 106 controls the rate of mold filling by controlling the angular velocity of rotation in the counterclockwise direction indicated by arrow "C" about the axis A. Because the rate of mold filling is controllable, relatively large gates can be used in the gating system 116, such that the metal front velocity is minimized, while simultaneously the volumetric fill rate is increased. As a result, temperature loss can be minimized and cycle time improved while maintaining turbulence-free filling. It will be appreciated by those of ordinary skill in the art that the actual gating geometry and dimensions are determined by the individual part to be cast.

The angular velocity can be variable to minimize turbulence without increasing the whole cycle fill time by allowing larger gates. Thus, the angular velocity can be greater to keep the metal flowing when more metal is needed, such as when bulky sections of casting are filled, and slower when less metal flow is needed. The angular velocity can, therefore, be controlled to maintain a critical metal front velocity of 0.5 m/sec. Although the mold fill rate in pounds per second, for example, is greater by up to 100% in the mold fill system 100 in comparison with conventional mold fill systems, the metal stream velocity is lower in some parts of the mold. The maximum metal velocity is about 10% of the maximum velocity of gravity pour molds and about 85–90% of the maximum velocity of low-pressure cast molds.

Figure 4:
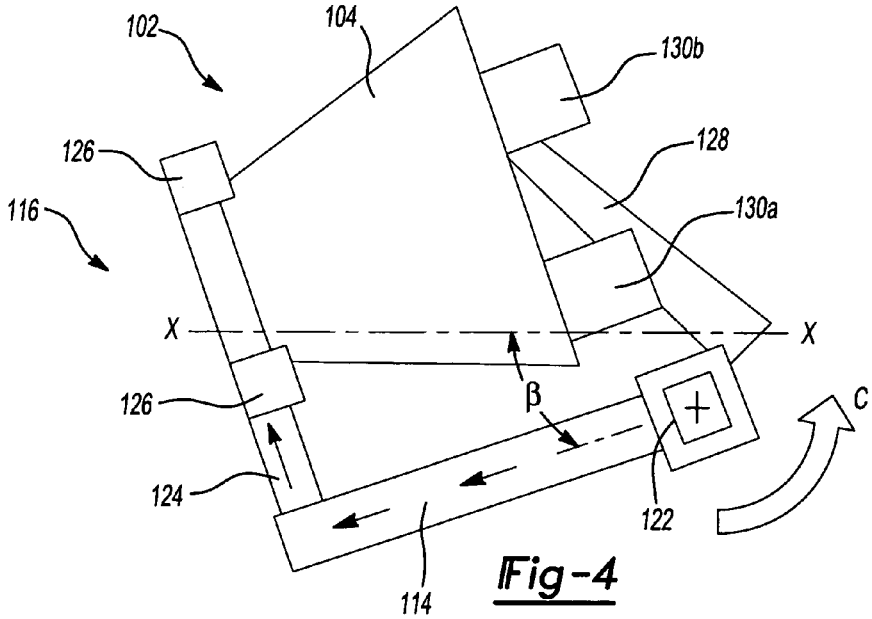
FIGS. 4–6 are side views of the mold fill apparatus of FIG. 3 at successive orientations about an horizontal axis of rotation during casting.

Referring to FIG. 4, the mold 102 is first rotated by a small angle β, bringing the first secondary runner 114 to a downward position and causing the molten metal to start filling the first secondary runners 114 and to rise uphill into the second secondary runners 124. In the position of FIG. 3, the metal level X indicates the filling process has just begun, because the metal level X has reached one of the third secondary runners 126 and metal is about to flow into the mold cavity 104.

Figure 5:
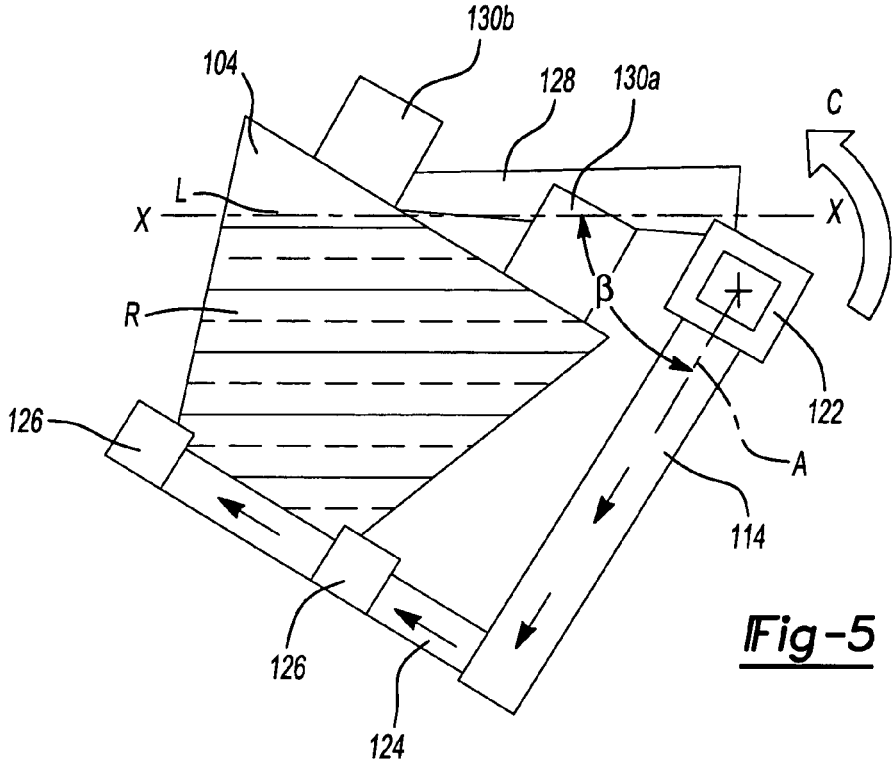

Referring to FIG. 5, after further counterclockwise rotation, the mold cavity 104 is almost full, having a large full portion "R" and a small empty portion "L". Metal flows from the third secondary runners 126, as indicated by the metal level X. In particular, the metal level X is such that the first top riser 130*a* now begins to fill from the tertiary runner 128 after the portion R of the mold cavity 104 (which is under the first top riser 130*a*) has been filed. Because the first top riser 130*a* is filled from the tertiary runner 128 with hot metal, filling the first top riser 130*a* serves to equalize the difference in temperatures that develops during the stages of mold fill in the mold cavity 104 under the first and second top risers 130*a*, 130*b*. The angle α and height h determine at what angle of rotation β about the axis A hot metal begins to flow gravitationally to the tertiary runner 128 to fill the risers 130*a*, 130*b*.

Figure 6:
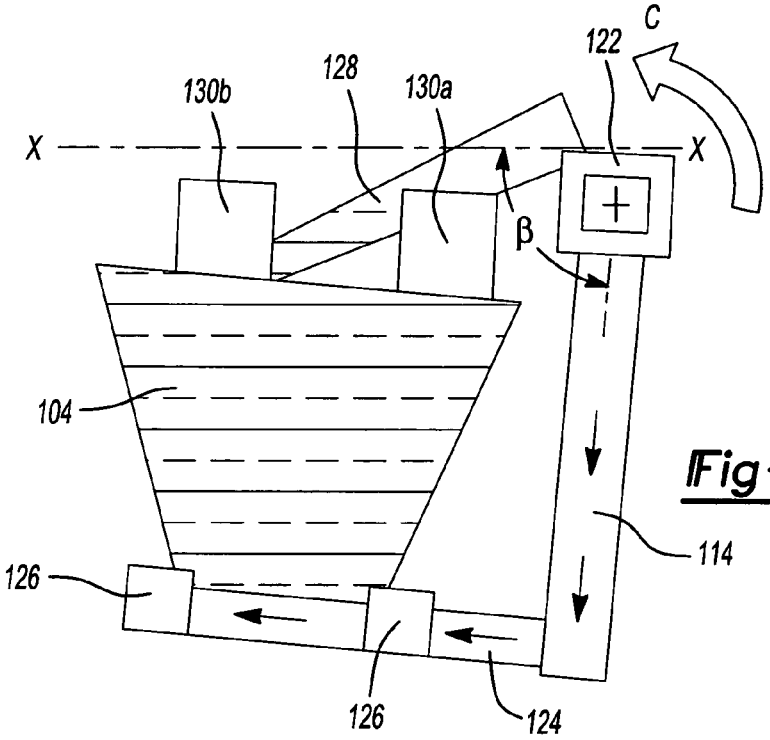

Referring to FIG. 6, further rotation to an angle of rotation β nearly equal to 90° from the starting position of FIG. 3 completely fills the mold cavity 104 and the first riser 130*a*, and has nearly completed filling the second riser 130*b*. Within 2° or 3° from the vertical position (angle β about 87°–88°), flow from the metal source 108 to the launder 112 is stopped by closing the stopper valve 120 or rotating the rotary furnace to a position that stops the metal flow. Referring to FIG. 7, the final rotation to β=90° allows metal to drain from the launder 112 into the gating system 116, thus eliminating spillage when the full mold 102 is immediately removed from the rotating seal to a cooling conveyor or holding station, to allow a new empty mold to be put in place of the full mold 102 for another cycle of casting. The empty mold that replaces the full mold in the position of FIG. 7 can be then rotated 270° from the position of FIG. 7 to the position of FIG. 3 and be ready for filling. In this process, a full mold 102 does not need to be rotated, thus reducing migrating defects caused by such full mold rotation.

From the above description, it will be appreciated that the revolving mold fill system 100 enables a quiescent or minimally turbulent metal fill in a cost-efficient configuration that utilizes, albeit in a new way, existing equipment, such as a conventional furnace and roll-over mechanism, and that does not require complex furnace controls. Mold filling is controlled by the speed of rotation of the mold 102 about the horizontal axis A of the primary runner 122, and overall the gating system 116 minimizes metal front velocities with metal flowing uphill relative to the mold cavity 104. Post-pour, shrinkage filling is effected by hot top risers 130*a*, 130*b* eliminating convection-induced flow.

While various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A method for filling a mold with molten metal during casting, the method comprising:

providing a horizontal primary runner of the mold defining a horizontal axis of rotation;

providing a plurality of secondary runners communicating with the primary runner;

filling the primary runner;

rotating the mold about the horizontal axis of rotation at an angular velocity; and filling the mold uphill from the secondary runners.

2. The method of claim 1, further comprising controlling metal flow to the primary runner from a metal source of constant metal level.

3. The method of claim 2, wherein controlling the metal flow comprises operating a stopper valve between the metal source and the primary runner.

4. The method of claim 2, wherein controlling the metal flow comprises operating a stopper rod valve between the metal source and the primary runner.

5. The method of claim 2, wherein controlling the metal flow comprises operating a slide gate valve between the metal source and the primary runner.

6. The method of claim 1, further comprising:

providing metal from a rotating furnace; and rotating the furnace such that metal flows from the furnace to the primary runner at constant metal level.

7. The method of claim 1, further comprising:

filling a tertiary runner communicating with the primary runner;

gravitationally filling at least one horizontal top riser from the tertiary runner; and gravitationally filling the mold from the top riser during solidification shrinkage.

8. The method of claim 1, wherein rotating the mold further comprises rotating the mold about the horizontal axis during mold filling by an angle of about 90°.

9. A mold fill system for filling a mold, the mold fill system comprising:

a horizontal primary runner defining a horizontal axis of rotation;

a gating subsystem comprising a plurality of secondary runners communicating with the primary runner; and a rotation mechanism for rotating the mold about the horizontal axis at an angular velocity, wherein the gating subsystem is configured to receive metal flow from the primary runner and fill the mold uphill during rotation of the mold.

10. The mold fill system of claim 9, further comprising a source of metal flow maintaining substantially constant metal level.

11. The mold fill system of claim 10, further comprising a stopper valve controlling the metal flow from the source to the primary runner.

12. The mold fill system of claim 11, wherein the stopper valve is a stopper rod valve.

13. The mold fill system of claim 11, wherein the stopper valve is a slide gate valve.

14. The mold fill system of claim 10, wherein the source is a rotating furnace.

15. The mold fill system of claim 9, wherein the rotation mechanism is a mold roll-over mechanism.

16. The mold fill system of claim 9, wherein the rotation mechanism is operable to control the angular velocity for maintaining a predetermined metal front velocity.

17. The mold fill system of claim 9, wherein the rotation mechanism is operable to control a mold filling rate.

18. The mold fill system of claim 9, further comprising:

at least one riser for shrinkage mold filling; and a tertiary runner communicating with the primary runner and operable for gravitational filling of the horizontal riser.

19. The mold fill system of claim 10, further comprising a rotating seal between the primary runner and a launder of the source.

20. The mold fill system of claim 10, further comprising at least one live vent from the mold to the atmosphere.

* * * * *